US009271561B2

(12) United States Patent
Chang

(10) Patent No.: US 9,271,561 B2
(45) Date of Patent: Mar. 1, 2016

(54) APPARATUS FOR IMPROVING THE INTERCHANGEABILITY OF PORTABLE ELECTRONIC DEVICES AMONGST VARIOUS SUPPORTS AND RELATED METHODS

(71) Applicant: David Chang, Houston, TX (US)

(72) Inventor: David Chang, Houston, TX (US)

( * ) Notice: Subject to any disclaimer, the term of this patent is extended or adjusted under 35 U.S.C. 154(b) by 138 days.

(21) Appl. No.: 14/175,683

(22) Filed: Feb. 7, 2014

(65) Prior Publication Data

US 2014/0305985 A1 Oct. 16, 2014

Related U.S. Application Data

(60) Provisional application No. 61/762,376, filed on Feb. 8, 2013.

(51) Int. Cl.
*A45F 5/02* (2006.01)

(52) U.S. Cl.
CPC ..... *A45F 5/021* (2013.01); *A45F 2005/025* (2013.01); *A45F 2200/0508* (2013.01); *A45F 2200/0516* (2013.01); *A45F 2200/0525* (2013.01)

(58) Field of Classification Search
CPC ..... A45F 5/021; A45F 2200/0508; A45F 2200/0516; A45F 2005/025
See application file for complete search history.

(56) References Cited

U.S. PATENT DOCUMENTS 5,187,744 A * 2/1993 Richter ..... B60R 11/0241 224/553
5,375,749 A * 12/1994 Oliva ..... A45F 5/02 224/242
5,551,079 A * 8/1996 Panther ..... H04B 1/086 340/7.63
5,653,367 A * 8/1997 Abramson ..... A45F 3/14 224/197
5,779,122 A * 7/1998 Martinelli ..... A45C 11/24 224/222
5,996,956 A * 12/1999 Shawver ..... G06F 1/1626 248/309.1
6,375,057 B1 * 4/2002 Gorchian ..... A45F 5/02 150/114
6,427,959 B1 * 8/2002 Kalis ..... H04M 1/04 248/288.11

(Continued)

*Primary Examiner* — Brian D Nash
(74) *Attorney, Agent, or Firm* — Buche & Associates, P.C.; John K. Buche

(57) ABSTRACT

Disclosed are apparatus and related methods of interchangeably securing (a) portable electronic devices or (b) portable electronic devices that are housed within protective cases to one more supports. In one embodiment, the apparatus may be a holster with a coupling means for removably securing the holster to a support (e.g., a clip, armband, or vehicle mount) that features cooperating coupling means. In another embodiment, the apparatus may be a protective case with a coupling means for removably securing the holster to a support that features cooperating coupling means.

7 Claims, 8 Drawing Sheets

(56) References Cited

U.S. PATENT DOCUMENTS 6,926,182 B2 * 8/2005 Cragg ..... A45F 5/021 224/236
8,191,838 B2 * 6/2012 Carter ..... B60R 11/02 16/367
8,276,863 B2 * 10/2012 Niwai ..... B60R 11/0241 224/483
8,622,447 B1 * 1/2014 Wirtz ..... H04B 1/385 224/217
2002/0139822 A1 * 10/2002 Infanti ..... A45F 5/00 224/197
2004/0251284 A1 * 12/2004 Pelligrini ..... A45F 5/02 224/198
2005/0092791 A1 * 5/2005 Labarca ..... A45F 5/02 224/269
2005/0135603 A1 * 6/2005 Stanford ..... A45F 5/02 379/454
2005/0199715 A1 * 9/2005 Reid ..... A45C 11/18 235/384
2006/0196902 A1 * 9/2006 Chen ..... A45F 5/02 224/197
2006/0215836 A1 * 9/2006 Wang ..... H04M 1/04 379/455
2007/0226958 A1 * 10/2007 Clifton, Jr. ..... A45F 5/02 24/3.12
2007/0294863 A1 * 12/2007 Johnson ..... A45F 5/02 24/3.12
2008/0006668 A1 * 1/2008 Nowacki ..... A45F 3/02 224/625
2010/0171021 A1 * 7/2010 Smith ..... A45C 13/30 248/558
2010/0288804 A1 * 11/2010 Youssefi-Shams ..... A45F 5/02 224/199
2011/0000945 A1 * 1/2011 Mongan ..... A45F 5/021 224/581
2011/0031287 A1 * 2/2011 Le Gette ..... F16M 11/04 224/101
2011/0073608 A1 * 3/2011 Richardson ..... A45C 11/00 220/737
2011/0132950 A1 * 6/2011 Culver ..... B60R 11/0241 224/485
2011/0278885 A1 * 11/2011 Procter ..... B60R 11/0235 297/135
2012/0048902 A1 * 3/2012 Clochard ..... B60R 11/02 224/282
2012/0280014 A1 * 11/2012 Lopez-Apodaca . B60R 11/0241 224/539
2012/0325882 A1 * 12/2012 Tages ..... A45F 5/021 224/676
2013/0032617 A1 * 2/2013 Adelman ..... A45F 5/00 224/191
2013/0270129 A1 * 10/2013 Johnson ..... A45C 11/38 206/216
2013/0299533 A1 * 11/2013 Gronewoller ..... A45F 5/021 224/191
2014/0097325 A1 * 4/2014 Berg ..... A45F 5/021 248/682

* cited by examiner

APPARATUS FOR IMPROVING THE INTERCHANGEABILITY OF PORTABLE ELECTRONIC DEVICES AMONGST VARIOUS SUPPORTS AND RELATED METHODS

CROSS-REFERENCE TO RELATED APPLICATIONS

This application claims the benefit of provisional patent application No. 61/762,376 filed on Feb. 8, 2013.

STATEMENT REGARDING FEDERALLY SPONSORED RESEARCH OR DEVELOPMENT

Not applicable.

FIELD OF THE APPLICATION

The application relates generally to interchangeably securing portable electronic devices housed within protective cases to one or more supports.

BACKGROUND

Mobile communication, media devices, and other portable electronics (hereinafter "mobile devices"), like cellular phones or smart phones, are frequently toted by people as they accomplish their daily activities. A close proximity to one's mobile device is viewed as a necessity to many people desirous of having communication or entertainment at their fingertips. This said, holding a mobile device in hand can be tedious and encumbering. In view of the foregoing, many hands-free mobile device toting or holding means have been developed. For instance, sometimes mobile devices are toted via belt clip holsters. Additionally, many people wear mobile devices on their biceps or shoulders during exercise routines so that the display of the device may be readily viewable with a slight head and arm gesture during an exercise (e.g., running). Yet still, people have been known to use various vehicle mounting systems so that a mobile device's display may be viewable within a vehicle (e.g., while driving).

Having multiple toting mechanisms for mobile devices can become problematic. Problems arise, for example, because mobile devices are relatively fragile and switching between the various holders or toting means can cause damage to the phone. Fragile mobile devices can be enclosed in protective cases, but protective cases raise other problems in view of holding and toting means because dimensions of protective cases are not constant for any particular mobile device. Inconsistent dimensioning of protective device cases becomes problematic in that the holding or toting means are usually sized to a particular mobile device without accounting for inconsistency in case sizing. As a result, mobile device owners must undesirably and tediously expose the phone to damage by removing the protective case prior to placing the device in a holder or toting means. In view of the foregoing, a need exists for apparatus and related methods of holding or toting mobile devices which do not unnecessarily expose the devices to damage.

SUMMARY

It is an object of the invention to describe apparatus and related methods of interchangeably securing portable electronic devices housed within protective cases to one or more supports. In one embodiment, the apparatus may be a mobile device holster with a coupling means for removably securing the holster to a support (e.g., a clip, armband, or vehicle mount) that features cooperating coupling means. Suitably, the disclosed holster is capable of retaining a cellular phone that is enclosed in a protective casing.

BRIEF DESCRIPTION

Figure 8A:
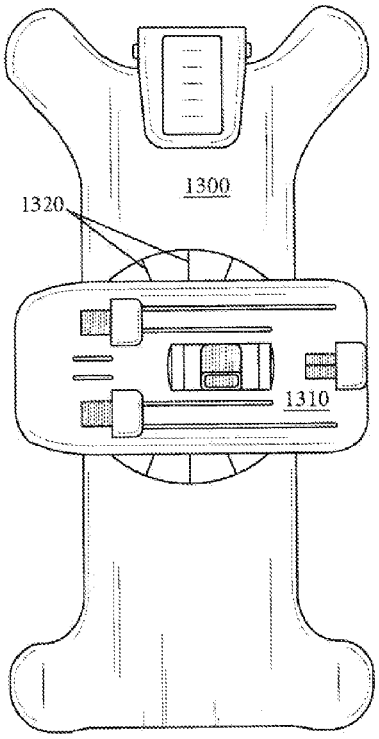
FIGS. 8A and 8B are respectively alternative back and front views of the holster of FIG. 1.
Figure 8B:
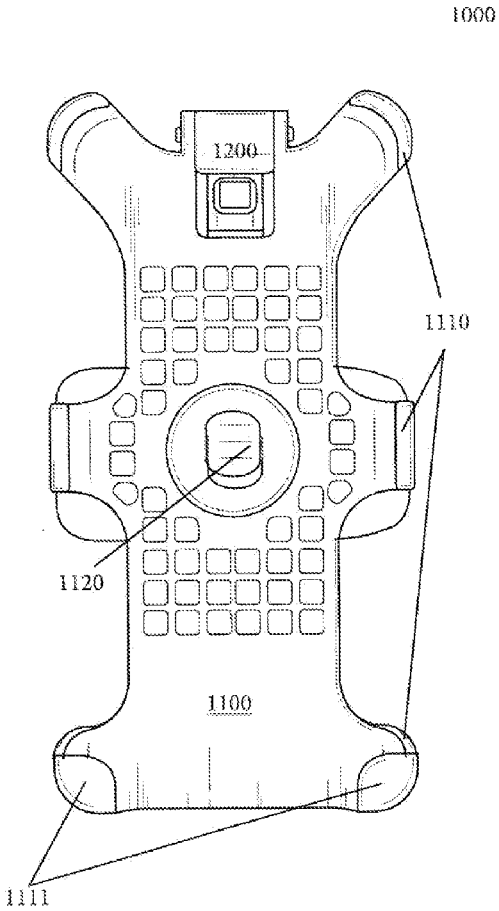
Figure 9:
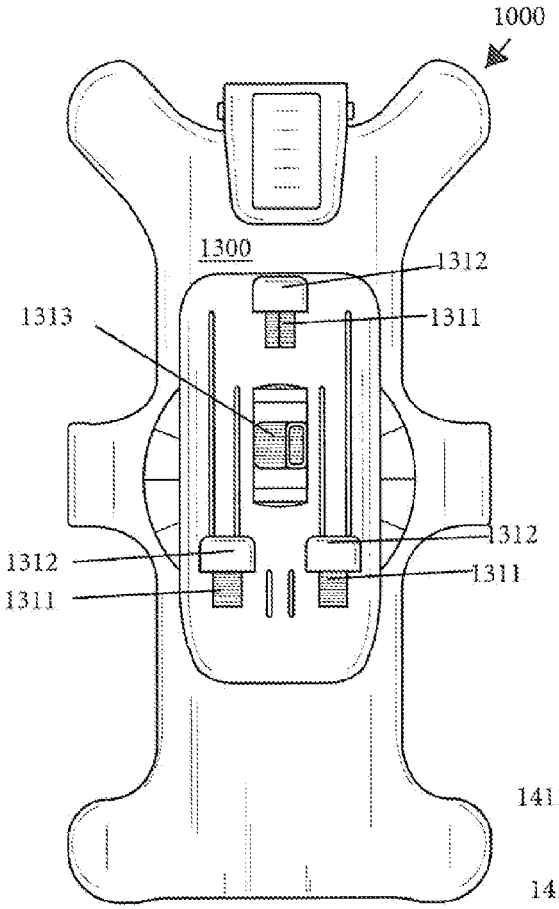
FIG. 9 is an alternate back view of the holster of FIG. 1.
Figure 9A:
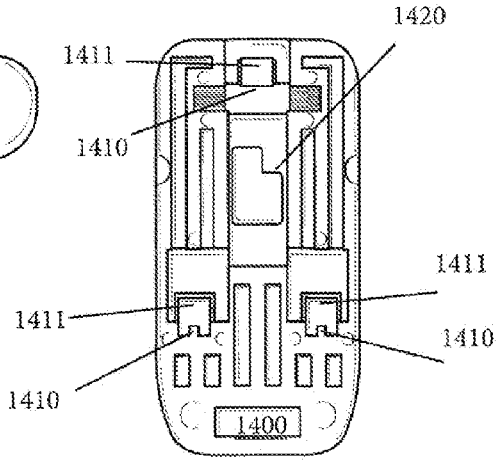

FIG. 9A a cooperating coupling means for the holster of FIGS. 1 through 9.

Figure 1:
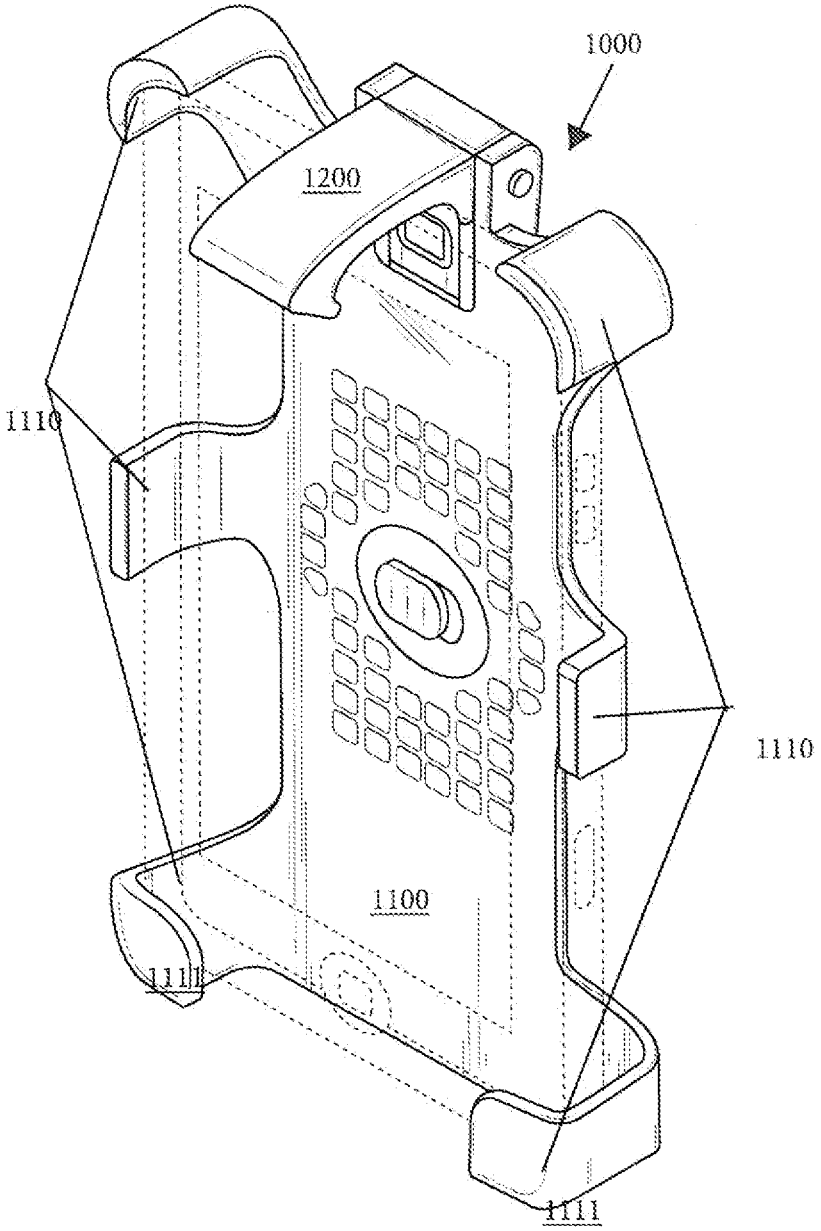
FIG. 1 is a perspective view of an interchangeable holster.
Figure 10A:
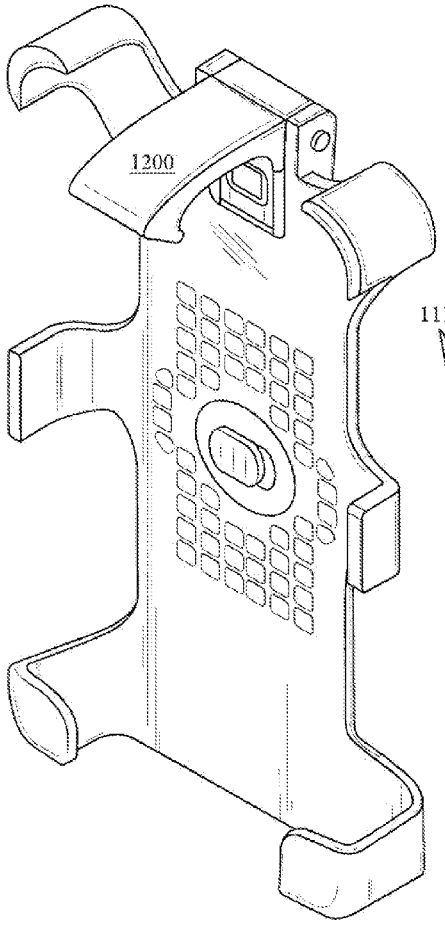
Figure 10B:
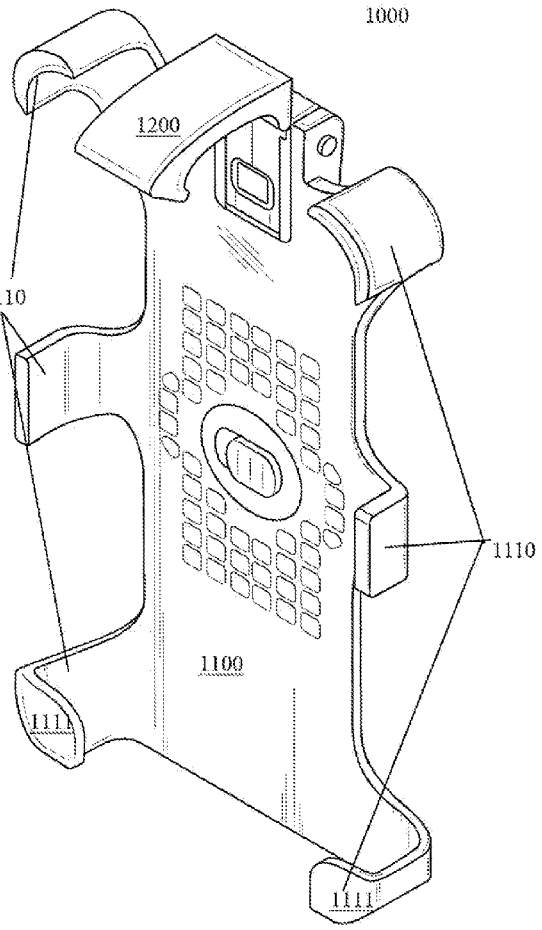

FIGS. 10A and 10B are perspective views of the holster of FIG. 1.

Figure 11:
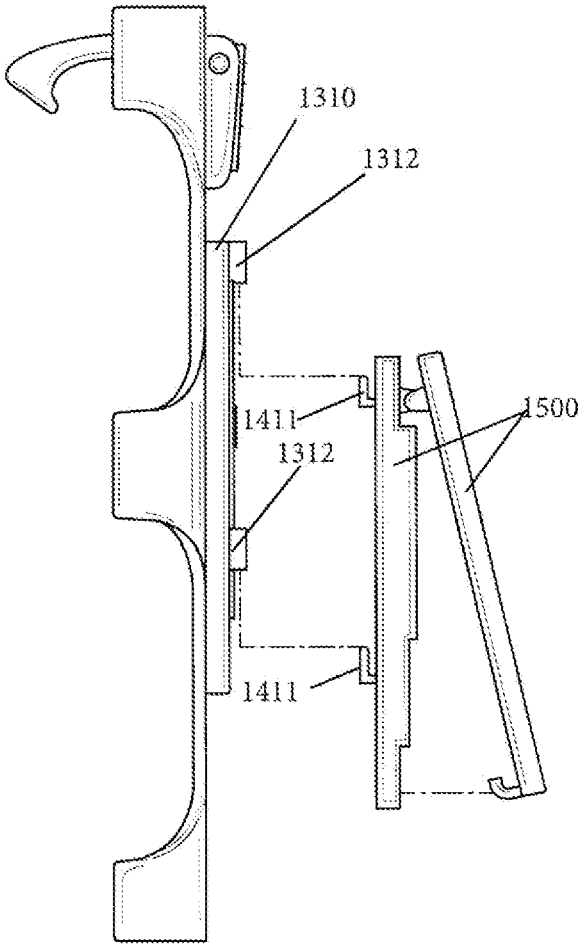

FIG. 11 is a yet another side view of the holster of FIG. 1.

In the figures, the following items are represented with the associated numerals:

1000 holster
1100 surface
1110 walls
1111 cupped corners
1120 release switch
1200 hook
1300 back surface
1310 rotatable coupling means
1311 indentation
1312 lip
1313 key
1320 grooves
1400 cooperating coupling means
1410 projection
1411 tongue
1420 ridge It has been discovered that a system, method, and device may be employed for interchangeably securing a portable electronic device housed within a protective case to multiple target supports, mounts, and the like. Heretofore, such a desirable achievement has not been considered possible, and accordingly, the system and method of this application measure up to the dignity of patentability and therefore, represent a patentable concept.

Before describing the invention in detail, it is to be understood that the present device and method are not limited to particular embodiments. It is also to be understood that the terminology used herein is for the purpose of describing particular embodiments only, and is not intended to be limiting. As used in this specification and the appended claims, the term "support" may include any holder for portable electronic devices including electronic devices housed within protective cases as the term is understood by the skilled artisan. Suitable supports may include, but are not limited to waist band clips, arm band mounts, and various stationary mounts operationally configured to securely hold a phone for one or more applications. Stationary mounts may include, but are not necessarily to desktop mount devices, vehicular dash board mount devices, and the like.

In one aspect, the application provides for the interchangeability of holsters for portable electronic devices with a plurality of supports. In another aspect, the application provides an interchangeable holster device that may be releasably attached to one or more smart phones or smart phone protective cases (stated differently, disclosed are interchangeable holsters operationally configured to hold a smart phone or smartphone with a protective case and removably secure the same to a support). In another aspect, the application provides a locking system for releasably securing a smart phone protective case or holster type device to one or more supports. In yet another aspect, the application provides a slidable locking mechanism operationally configured to releasably attach a support to a protective case or a holster type device.

DETAILED DISCUSSION

Disclosed are apparatus and related methods of interchangeably securing (a) portable electronic devices or (b) portable electronic devices that are housed within protective cases to one or more supports. In one embodiment, the apparatus may be a holster with a coupling means for removably securing the holster to a support (e.g., a dip, armband, or vehicle mount) that features cooperating coupling means. In another embodiment, the apparatus may be a protective case with the coupling means for removably securing the case to a support that features the cooperating coupling means.

FIGS. 1 through 7 respectively depict perspective, front, back, left side, right side, top and bottom views of a preferred embodiment of a mobile device holster 1000. A mobile device is shown in broken lines. As shown in those figures, the holster 1000 features: a front surface 1100 (shown in FIGS. 1, 2, 4, 5, and 7) with a release switch 1120 and walls 1110 for retaining an encased or unprotected mobile device adjacent to the front surface 1100 within the walls 1110; a hook 1200 (shown in FIGS. 1, 2, 4, 5, and 7) for securing the encased or unprotected mobile device within the walls 1110 and against the front surface 1; and, a back surface 1300 with a rotatable coupling means 1310 secured thereto. As shown in FIG. 1, the walls 1000 are generally (a) provided around the corners and along the sides of the holster 1000 and (b) defined as perpendicular or oblique projections to at least a portion of the front surface 1100. As shown, the two bottom walls 1111 or corners of the holster 1000 are configured to receive the butt of a rectangular electronic device or phone (not shown). Said configuration may be accomplished via cupping or curling the walls 1111 or corners whereby the butt of a phone (see FIG. 1 wherein the phone is shown in broken lines) may be provided into the corner before the remainder of the device is positioned between the other side walls 1110 against the front surface 1100. As discussed further below, the hook 1200 and bottom walls 1111 or corners interact with a phone so that the same does not disengage from its holstered position.

Figure 2:
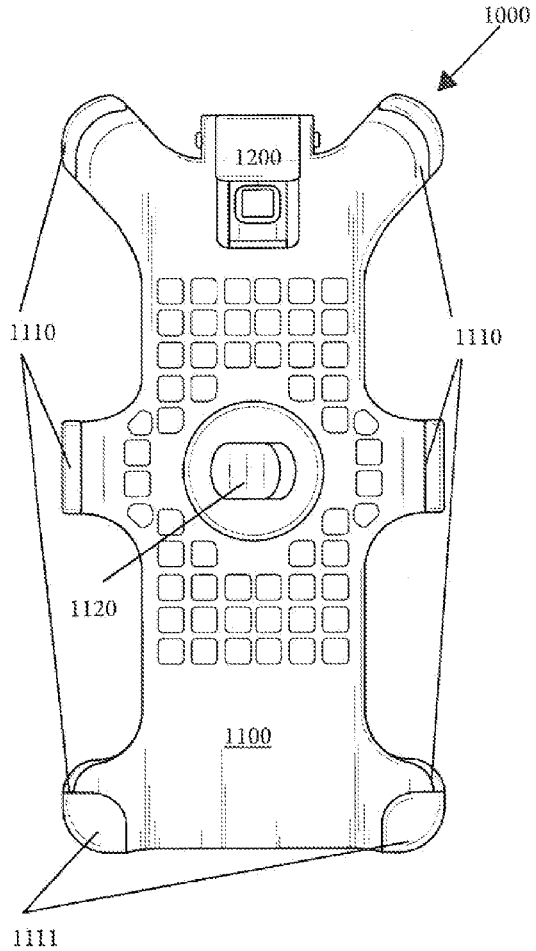
FIG. 2 is a front view of the holster of FIG. 1.
Figure 3:
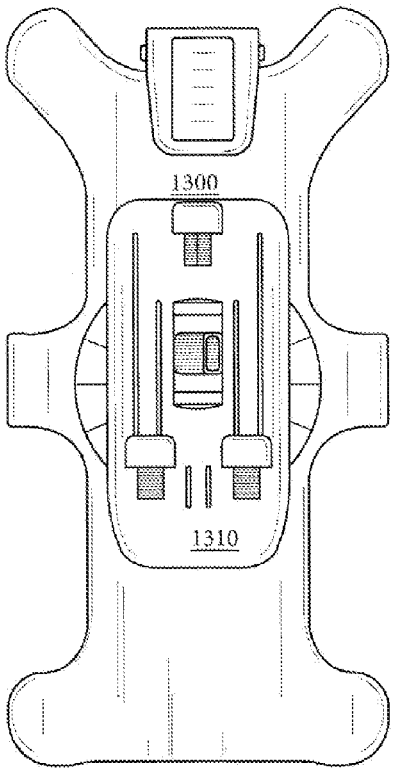
FIG. 3 is a back view of the holster of FIG. 1.
Figures 4, 5:
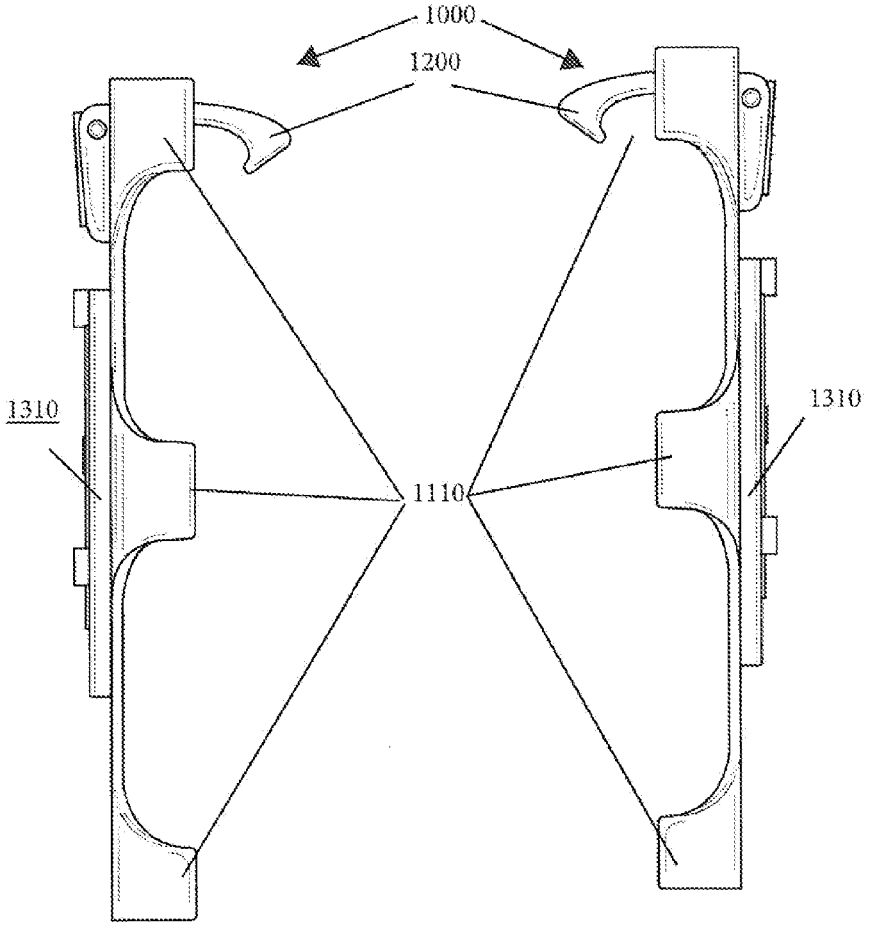
FIG. 4 is a side view of the holster of FIG. 1.
FIG. 5 is another side view of the holster of FIG. 1.
Figure 6:
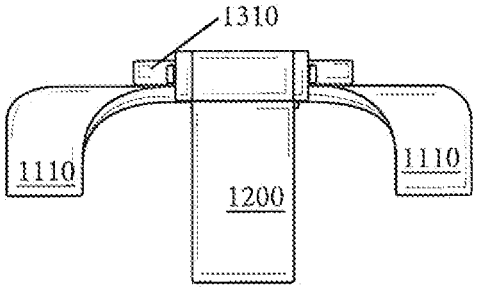
FIG. 6 is a top view of the holster of FIG. 1.
Figure 7:
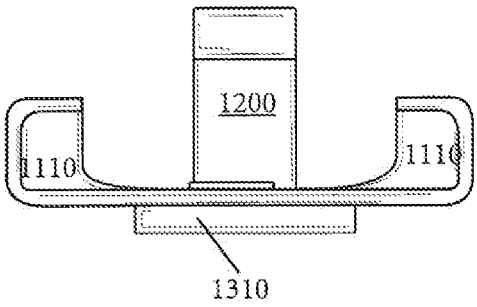
FIG. 7 is a bottom view of the holster of FIG. 1.

Like FIGS. 2 and 3, FIGS. 8A and 8B are respectively front and back views of the holster 1000 of FIGS. 1 and 4 through 7. However, a comparison of FIGS. 2 and 3 with FIGS. 7 and 8 illustrate one of the operations of the rotatable coupling means 1310. Specifically, the rotatable coupling means 1310 is configured to rotate relative to the back surface 1300 of the holster 1000. Preferably, the release switch 1120 and coupling means 1310 are mechanically connected, whereby the release switch rotates relative to the front surface 1100 to the same degree as the coupling means 1310 rotates relative to the back surface 1300. As shown, the coupling means 1310 of FIG. 8B and the release switch 1120 of FIG. 8A are rotated by ninety degrees relative to said components' position in FIGS. 2 and 3. This said, the coupling means 1310 and release switch 1120 may be rotated by any degree relative to their respective surfaces 1100, 1300. In one embodiment, the rotatability of the coupling means 1310 is accomplished via providing a cylinder, including the release switch 1120 and the coupling means 1310, through the body of the holster 1000 wherein the coupling means 1310 is rotatably secured to the holster body. Referring to FIGS. 2 and 8B, the back surface 1300 of the holster 1000 further features a circular array of radial depressions 1320 for receiving a corresponding tongue (not shown) on the back of the coupling means 1310 so that when the tongue (not shown) interacts with a groove 1310, rotation is restricted until the tongue and groove are disassociated.

FIG. 9 is an alternate back view of the holster 1000 and coupling means 1310 of the earlier figures. FIG. 9A depicts a cooperating coupling means 1400 for interacting with the coupling means 1310 of the holster 1000. Suitably, the cooperating coupling means 1400 (see FIG. 9A) may be provided to a support so that the coupling means 1310 may interact with the cooperating coupling means 1400 for securing the holster 1000 to the support (like a belt clip, arm band, or stand) (not shown). FIG. 11 shows a side view of the coupling means 1310 on the holster and the corresponding coupling means 1400 on a dip 1500. Referring to FIGS. 9, 9A and 11, in one embodiment, the coupling means 1310 features at least one indentation 1311 with a lip 1312 while the cooperating coupling means 1400 features at least one projection 1410 with a tongue 1411 wherein the lip 1312 and tongue 1411 interact to couple the coupling means 1310 and cooperating coupling means 1400. Suitably, a coupling may take place via providing the projection 1410 to a corresponding indentation 1311 and shifting the coupling means 1310 and 1400 relative to one another so that the lip 1312 and tongue 1411 interact (See the broken lines in FIG. 11). Referring to FIGS. 9 and 9A, in one embodiment, the coupling of the coupling means 1310, 1400 may be locked via interaction of a key 1313 to a ridge 1420, wherein the key 1313 features an edge that interacts with the ridge 1420 to prevent shifting of the coupling means 1310, 1400 relative to one another so that the lips 1312 and tongues 1411 cannot disassociate, and wherein the key 1313 may be moved relative to the ridge 1420 via manipulation of the release switch 1120 (FIG. 2).

FIGS. 10A and 10B are alternative perspective views of the holster 1000 and illustrate the operations of the hook 1200. Suitably, the hook 1200 is movable relative the front surface so that a device or encased device may be retained or released from the holster 1000. As alluded to above, the two walls 1111 in the bottom corners of the holster 1000 are cupped or curled whereby, when the holster 1000 retains a device or protective casing of a device, the holster corners 1111 and the hook 1200 respectively interact with a butt and an opposing side edge of the device or casing so that the device or encased device is retained within the holster 1000. FIGS. 10A and 10B illustrate a preferred embodiment where the location of the hook 1200 may be shifted away from or toward the holster 1000 so that the hook may release the edge of the device or encased device whereby the device may be unholstered or locked within the holster 1000. Suitably, the hook may be adjusted to accommodate various phone models, e.g., Samsung Galaxy®, iphone®, and etc. In an alternate or same embodiment, the hook 1200 may be configured to pivot toward or away from the electronic device.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A system for supporting a portable electronic device, said system comprising;

a first support with a first coupling means;

a second support with a second coupling means a holster with a front surface with at least one cupped side wall and a hook for retaining the portable electronic device within the confines of the sidewalls;

a back surface with a third coupling means, wherein the third coupling means is configured for removable attachment to the first and second coupling means wherein the third coupling means is configured with at least one lip;

wherein the first and second coupling means are each configured with a tongue; and, wherein at least one lip is configured to interface with either of said tongue(s) to accomplish.

2. The system of claim 1 wherein the first support is selected from the group consisting essentially of an arm band, a belt clip, or a vehicle mount.

3. The system of claim 1 wherein the second support is selected from the group consisting essentially of an arm band, a belt clip, or a vehicle mount.

4. The system of claim 1 wherein:

the third coupling means is configured with a key;

the first and second coupling means are each configured with a ridge; and, the key is configured to interface with either of said ridge(s).

5. A method of supporting a mobile device comprising the steps of:

placing the butt of a mobile device into cupped corners of a holster, said holster defined by a front surface with sidewalls, the cupped corners, a hook, a first coupling means, and a second coupling means, wherein the surface is configured with at least a key, wherein the surface is further configured with at least one lip, wherein the first support is configured with a first tongue and a first ridge, wherein the second support is configured with a second tongue and a second ridge, and, wherein at least one lip is configured to interface with either of the first or second tongues and the key is configured interface with either of the first or second ridges;

placing the mobile device against the front surface of the holster so that the mobile device is retained against the front surface and within the confines of the side walls via the cupped corners and hooks;

removably attaching the holster to a first support via the first coupling means;

removing the holster from the first support; and, removably attaching the holster to the second support via the second coupling means.

6. The method of claim 5 wherein the first support is selected from the group consisting essentially of an arm band, a belt clip, or a vehicle mount.

7. The method of claim 5 wherein the second support is selected from the group consisting essentially of an arm band, a belt clip, or a vehicle mount.

* * * * *